United States Patent [19]

Miwa

[11] Patent Number: 5,041,167

[45] Date of Patent: Aug. 20, 1991

[54] METHOD OF MAKING STEEL MEMBER

[75] Inventor: Yoshihisa Miwa, Aki, Japan

[73] Assignee: Mazda Motor Corporation, Hiroshima, Japan

[21] Appl. No.: 443,161

[22] Filed: Nov. 30, 1989

[30] Foreign Application Priority Data

Dec. 3, 1988 [JP] Japan ..... 63-306313

[51] Int. Cl.[5] ..... C21D 8/00

[52] U.S. Cl. ..... 148/12 EA; 148/12 F; 148/16.6

[58] Field of Search ..... 148/12 F, 12 EA, 16.6, 148/334

[56] References Cited

FOREIGN PATENT DOCUMENTS 57-123920 8/1982 Japan ..... 148/12 F
59-140328 8/1984 Japan .
61-31184 7/1986 Japan .

*Primary Examiner*—Deborah Yee

*Attorney, Agent, or Firm*—Wenderoth, Lind & Ponack

[57] ABSTRACT

A method for manufacturing a steel member which comprises the steps of preparing a steel material of a composition containing C in a quantity of 0.15 to 0.35 wt %, Si in a quantity of not greater than 0.50 wt %, Mo in a quantity of 0.05 to 0.50 wt %, Mn in a quantity of 0.50 to 1.30 wt %, Cr in a quantity of 0.50 to 1.30 wt %, V in a quantity of 0.05 to 0.20 wt %, N in a quantity not greater than 0.02 wt %, Al in a quantity of not greater than 0.10 wt % and Fe being the balance relative to the total weight of the steel material, wherein the product of the sum of the Mn content and the Cr content times the Mo content is chosen to be within the range of 0.1 to 0.6, hot-forging the steel material at a predetermined heating temperature to provide the steel member, and continuously cooling the steel member at a predetermined cooling speed of 0.4° to 4.0° C./sec to impart a substantially bainite structure or a combined bainite and ferrite structure to the steel member.

15 Claims, 2 Drawing Sheets

METHOD OF MAKING STEEL MEMBER

BACKGROUND OF THE INVENTION

1. Field of the Invention

The present invention generally relates to a method of manufacturing a steel member such as, for example, automobile structural component parts, and more particularly to the method of manufacturing the steel member of high physical strength and toughness having a bainitic structure as a principal structure.

2. Description of the Prior Art

Hitherto, a steel member which requires a tensile strength within the range of about 70 to 100 kgf/mm$^2$ (corresponding to Vickers hardness Hv of 220 to 320) has often been manufactured by heat-treating (tempering) carbon steel or alloyed steel.

Recently, however, a non-tempered steel having a physical strength comparable to the tempered steel has become widely used. This non-tempered steel is, for the purpose of reducing the cost incurred during the heat-treatment, manufactured by hot-forging the material added with vanadium and subsequently air-cooling it. The non-tempered steel so manufactured by the process of hot-forging followed by air-cooling tends to result in a coarse grain size in crystalline structure and exhibits a substantially pearlite structure. Therefore, as compared with the tempered steel, the non-tempered steel low in toughness (that is, low in impact strength) and, accordingly, the application thereof is limited.

On the other hand, the Japanese Patent Publication No. 61-31184, published July 18, 1986, discloses a technique of manufacturing a steel product having an excellent resistance to any one of fatigue, wear, pitting and spalling. As the starting material, the method of the above described publication employs the non-tempered steel which is of a particular composition containing carbon (C) in a quantity within the range of 0.15 to 0.35 wt. %, silicon (Si) in a quantity of not greater than 0.35 wt %, manganese (Mn) in a quantity within the range of 0.60 to 1.30 wt. %, chromium (Cr) in a quantity within the range of 0.70 to 1.50 wt. %, vanadium (V) in a quantity within the range of 0.05 to 0.50 wt. %, nitrogen (N) within the range of 0.006 to 0.020 wt. %, and solid aluminum (sol. Al) in a quantity within the range of 0.02 to 0.10 wt. %, the balance being iron (Fe) and indispensable impurities, relative to the total weight of the non-tempered steel. The publication also describes that one or more of sulfur (S) in a quantity within the range of 0.04 to 0.13 wt. %, lead (Pb) in a quantity within the range of 0.03 to 0.35 wt. % and calcium (Ca) in a quantity within the range of 0.0010 to 0.0100 wt. % may be employed in the composition of the non-tempered steel.

According to the above mentioned publication, the starting material, that is, the non-tempered steel is first heat-treated at a temperature higher than the $A_3$ transformation point and is subsequently cooled. In order to obtain a structure including ferrite and pearlite in a surface region of the non-tempered steel so that the subsequent nitriding processing can develop extreme hardness in the surface region of the non-tempered steel, the cooling of the heat-treated steel from 800° C. down to 500° C. is carried out in a controlled fashion, specifically at a cooling speed of 2° C. per second or lower.

The reason that the non-tempered steel generally has a low toughness is partly because the steel is made up of pearlite or a combination of ferrite and pearlite and partly because the crystalline grain size is coarse.

As regards the reduction in toughness as a result of the presence of the pearlite or a combination of ferrite and pearlite, it is well known that the toughness of the steel may be increased if the steel is made up of bainite or a combination of ferrite and bainite. While isothermal cooling from the austenitizing temperature (about 730° C.), that is, austempering, would be effective to develop the bainite structure, the austempering process lacks a practical applicability due to processing time and cost.

Therefore, to develop the bainite structure with the use of a continuous cooling, or anisothermal cooling technique, an attempt have been made to add one or both of Mn (manganese) and Cr (chromium), which are an element used to improve the hardenability, or to adjust the amount of one or both of Mn and Cr used. However, this attempt makes it difficult to determine the appropriate cooling speed and hence to form the stable bainite structure. In other words, if the cooling speed is excessively low, the steel will become a pearlitic structure, but if it is excessively high, it will become a martensitic structure.

A reduction in toughness of the non-tempered steel as a result of the coarse crystalline grain size may be avoided if the steel material is, after the hot-forging, normalized to make the grain size to be greater than No. 6 (rating according to Japanese Industrial Standards, JIS, or ASTM). However, the finer the grain size, the more is the hardenability of the steel lowered, and it will become difficult to form the stable bainite or a combination of bainite and ferrite in the ordinary steel.

As hereinabove discussed, since the amount of the hardenability improving element or elements used, the cooling speed and the grain size and closely related with each other, no technique has yet been available to form the stable bainite or a combined ferrite and bainite structure by the use of the continuous cooling.

SUMMARY OF THE INVENTION

Accordingly, the present invention has been devised with a view to providing a method of manufacturing a steel member of high in toughness having a bainitric structure or a combined ferrite and bainite structure formed by the use of a continuous cooling technique, that is, an anisothermal cooling technique.

In order to accomplish the above described object of the present invention, the method herein disclosed makes use of, as a starting material, a steel material of a composition containing C (carbon) in a quantity of 0.15 to 0.35 wt. %, Si (silicon) in a quantity of not greater than 0.50 wt. %, Mo (molybdenum) in a quantity of 0.05 to 0.50 wt. %, Mn (manganese) in a quantity of 0.50 to 1.30 wt. %, Cr (chromium) in a quantity of 0.50 to 1.30 wt. %, V (vanadium) in a quantity of 0.05 to 0.20 wt. %, N (nitrogen) in a quantity not greater than 0.02 wt. %, Al (aluminum) in a quantity of not greater than 0.10 wt. % and Fe (iron) being the balance relative to the total weight of the steel material, wherein the product of the sum of the Mn content and the Cr content times the Mo content is chosen to be within the range of 0.1 to 0.6.

According to one preferred embodiment of the present invention, the starting material is heat-treated, for example, hot-forged, at a predetermined heating temperature, followed by a continuous cooling of the steel material at a predetermined cooling speed of 0.4° to 4° C. per second from the predetermined heating temperature down to a predetermined temperature, thereby to render the resultant steel product to represent substantially a bainite structure or a combined bainite and ferrite structure. The predetermined temperature to which the hot-forged steel material is cooled may be a temperature of about 500° C. at which transformation terminates, and the continuous cooling may be carried out by the use of a forced air cooling technique.

The predetermined heating temperature at which the hot-forging of the steel material of the specific composition is carried out may be within the range of 850° to 950° C. Alternatively, it may be carried out at a temperature either higher or lower than the predetermined heating temperature. Where the steel material of the specific composition is hot-forged at the predetermined heating temperature or higher than it, the controlled continuous cooling should be effected from the predetermined heating temperature.

On the other hand, where the steel material of the specific composition is hot-forged at a temperature lower than the predetermined heating temperature, or where the steel material once hot-forged at the predetermined heating temperature or at a temperature higher than it is cooled in any way whatsoever down to a temperature lower than the predetermined heating temperature, the controlled cooling may be carried out after the steel material has been again heated to the predetermined heating temperature, that is, to 850° to 950° C.

According to the present invention, the unique selection of the respective amounts of Mo, Mn and Cr, each of which is a hardenability improving element, and the use of the controlled continuous cooling having made it possible to obtain the bainite structure or the combined bainite and ferrite structure in the resultant steel member.

Although Mo would not improve the hardenability necessary to accomplish the martensitic transformation so much as expected, it serves to improve the hardenability necessary to accomplish the bainitic transformation, that is, it serves as an element for accelerating bainitization, that is, the formation of bainite, during the cooling process. On the other hand, both of Mn and Cr are an element effective to improve the hardenability necessary to accomplish both of the martensitic transformation and the bainitization, that is, an element effective to accelerate both of the martensitic transformation and the bainitic transformation.

Where the amount of Mo is not greater than 0.05 wt. %, the bainitization, that is, the formation of bainite, will not take place sufficiently, but where it is greater than 0.50 wt. %, the bainitizing effect of the element will be saturated and, also, the machinability will be impaired.

Mn is an element essential for the deoxidization during the manufacture of steel and, at the same time, an element effective to improve the hardenability necessary to accomplish the martensitic transformation and the bainitic transformation. The use of Mn in a quantity not smaller than 0.50 wt. % is essential to accomplish the hardenability necessary to precipitate bainite, however, the use of Mn in a quantity greater than 1.30 wt. % will render the hardenability to be excessive with the machinability reduced concomitantly.

Cr is an element that brings about effects similar to Mn, that is, an element effective to improve the hardenability necessary to accomplish the martensitic transformation and the bainitic transformation. This element also serves to form a nitride in a surface region of steel when coupled with nitrogen during a nitriding process, thereby to increase the surface hardness of the steel. Accordingly, in order to maximize the hardenability improvement achieved by the use of Cr, the amount of this element must be not smaller than 0.50 wt. %, however, the use of this element in a quantity greater than 1.30 wt. % may result in an excessive hardenability with martensite precipitated consequently.

Since as hereinbefore discussed both of Mn and Cr serve to accelerate bainitization and martensitization, that is, to accelerate the formation of bainite and the formation of martensite, the product of the sum of the Mn content and the Cr content multiplied by the Mo content, which is hereinafter referred to as "$(Mn+Cr)\times Mo$ value", is chosen to be within the range of 0.1 to 0.6. If this $(Mn+Cr)\times Mo$ value is not greater than 0.1, the bainitization will be accelerated insufficiently enough to result in the formation of a pearlite structure, but if this value is greater than 0.6, an excessive martensitization will take place to such an extent as to result in the formation of a martensite structure.

In other words, where the amount of Mo used is relatively small or great within the required range of amount, the sum of the respective amounts of Mn and Cr has to be increased or decreased, respectively. In any event, the range of 0.1 to 0.6 for the $(Mn+Cr)\times Mo$ value has been determined experimentally.

As hereinbefore described, the present invention is practiced by preparing the steel material containing, inter alia, 0.05 to 0.50 wt. % of Mo, 0.50 to 1.30 wt. % of Mn and 0.50 to 1.30 wt. % of Cr and having the $(Mn+Cr)\times Mo$ value within the range of 0.1 to 0.6, heating the steel material at the predetermined heating temperature of 850° to 950° C., or a temperature either higher or lower than the predetermined heating temperature, and continuously cooling the heated steel material at the predetermined cooling speed of 0.4° to 4.0° C. per second from the predetermined heating temperature down to a lower temperature, for example, room temperature.

If the temperature at which the steel material of the specific composition is heat-treated is lower than the predetermined heating temperature, the steel material once heat-treated at such temperature is again heated to the predetermined heating temperature, followed by the continuous cooling thereof at the predetermined cooling speed from the predetermined heating temperature down to a lower temperature, for example, room temperature.

If the lowest temperature of the steel material from which the continuous cooling is started is not higher than 850° C., solid solution of alloying elements such as Mo, Mn and Cr will be insufficient with no continuous cooling transformation exhibited and, consequently, the bainite structure will not be formed. On the other hand, if the highest temperature of the steel material from which the continuous cooling is started is not lower than 950° C., the grain would become coarse to such an extent that the toughness of the resultant steel member will be reduced and, at the same time, a portion of fine carbonitrile of vanadium precipitated subsequent to the hot-forging may be again formed into a solid solution thereby hampering the formation of a matrix of sufficient hardness.

In the practice of the present invention, it is essential that the continuous cooling has to be carried out at the predetermined cooling speed of 0.4° to 4.0° C./sec. If the cooling speed is not higher than 0.4° C./sec, pearlite will be precipitated in a major portion of the steel and neither the bainite structure nor the combined bainite and ferrite structure will be obtained. On the other hand, if the cooling speed is higher than 0.4° C./sec, martensite will be precipitated in a major portion of the steel and neither the bainite structure nor the combined bainite and ferrite structure will be obtained.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENTS

Hereinafter, the present invention will be described in connection with preferred embodiments thereof with reference to the accompanying drawings.

As hereinbefore described, the present invention is aimed at providing a method for the manufacturing of a steel member wherein a steel material containing at least Mo, Mn and Cr is, after having been hot-forged or after having been hot-forged and then re-heated, cooled continuously to form a bainite structure or a combined bainite and ferrite structure in the resultant steel member so that the latter can exhibit an increased physical strength and an increased toughness.

Figure 1:
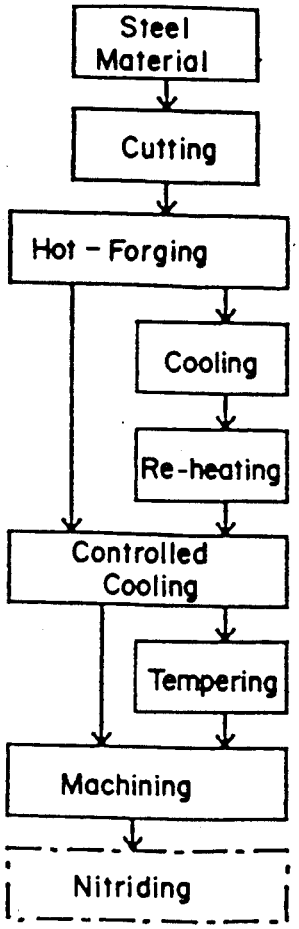
FIG. 1 is a chart showing the sequence of manufacture of a steel member according to the present invention.

This method will now be described with reference to FIG. 1.

As a starting material, the steel material of the following composition is employed, it being to be noted that the percent by weight of each of the following alloying elements is in relation to the total weight of the steel material.

C: 0.15 to 0.35 wt. %; Si: not greater than 0.50 wt. %; Mo: 0.05 to 0.50 wt. %; Mn: 0.50 to 1.30 wt. % Cr: 0.50 to 1.30 wt. %; V: 0.05 to 0.20 wt. %; N: Not greater than 0.02 wt. %; Al: Not greater than 0.10 wt. %.

$(Mn+Cr)\times Mo$ value: 0.1 to 0.6

In addition, if desired, the following elements may be added to the starting material.

S: Not greater than 0.20 wt. %

Pb: Not greater than 0.35 wt. %

C is an important element which participates in increase of the hardness of the matrix. In order for the bainite structure or the combined bainite and ferrite structure to exhibit Vickers hardness Hv of 220 to 320, the use of C in a quantity at least not smaller than 0.15 wt. % is essential. However, the use of C in a quantity not smaller than 0.35 wt. % will lower both of the toughness and the machinability.

Si is an element effective to secure a sufficient hardness in matrix as is the case with C. The use of Si in a quantity greater than 50 wt. % will lower the machinability and should therefore be avoided.

Mn is an element necessary not only for accomplishing the deoxidization during the manufacture of steel, but also for increasing the hardenability for accomplishing the martensitic transformation and the bainitic transformation. In order to obtain the hardenability necessary to precipitate bainite, the use of Mn in a quantity not smaller than 0.50 wt. % is essential. Where the amount of Mn is greater than 1.30 wt. %, the hardenability will become excessive enough to precipitate martensite with the machinability lowered concomitantly.

Cr is an element effective to improve the hardenability for accomplishing the martensitic transformation and the bainitic transformation as is the case with Mn and, also, an element which, when subjected to a nitriding process, couples with nitrogen to form a nitride in a surface region thereby to increase the surface hardness of the steel member. In order to obtain the effect of improving the hardenability, the use of Cr in a quantity not smaller than 0.50 wt. % is essential, while the use of Cr in a quantity greater than 1.30 wt. % may result in an excessive hardenability enough to precipitate martensite.

In addition to the use of the above described elements in the above described respective quantities, the practice of the method of the present invention requires the use of Mo within the range of 0.05 to 0.50 wt. % and, also, the $(Mn+Cr)\times Mo$ value to be within the range of 0.1 to 0.6.

Mo is an element effective to improve the hardenability as is the case with any one of Mn and Cr. In particular, Mo is an important element effective to improve the hardenability necessary to accomplish the bainitic transformation thereby to accelerate bainitization, that is, to accelerate the formation of bainite. The effect to accelerate the bainitization can be obtained when Mo is used in a quantity not greater than 0.05 wt. % but the use of Mo in a quantity greater than 0.05 wt. % may result not only in a saturation of the effect, but also in a reduction in machinability and, therefore, should be avoided.

Also, since any one of Mo, Mn and Cr is an element used to improve the hardenability, the use of any one of Mn and Cr in a relatively great quantity makes it necessary to use Mo in a relatively small quantity. Conversely, the use of any one of Mn and Cr in a relatively small quantity makes it necessary to use Mo in a relatively great quantity. It has been found, as illustrated by results of experiments set forth under Experiment I as will be described later, that the quantity of any one of Mn and Cr to be used can be coordinated with the quantity of Mo to be used by selecting the $(Mn+Cr)\times Mo$ value to be within the range of 0.1 to 0.6 which is required to precipitate bainite.

V is an element which, when coupled with C and N contained in the steel material, forms a carbonitrile thereby to increase the hardness of the matrix. This effect can be accomplished if V is employed in a quantity not smaller than 0.05 wt. %. On the other hand, if V is employed in a quantity greater than 0.20 wt. %, both of the toughness and the machinability will be lowered.

The quantity of Al used in the practice of the method of the present invention must be not greater than 0.10 wt. %. Al is effective to form a hard AlN when combined with N contained in the steel material, thereby to avoid any possible coarsening of the crystalline grain size which would otherwise take place when the steel material is heated to a temperature higher than the austenitizing temperature. If Al is employed in a quantity greater than 0.10 wt. %, not only is the effect of Al to avoid the coarsening of the grain size saturated, but also the machinability tends to be lowered.

The quantity of N used in the practice of the method of the present invention must be not greater than 0.02 wt. %. N is an element which forms the hard AlN when combined with Al and, also, which acts to precipitate a hard compound necessary to increase the hardness of the matrix when combined with V and also to avoid any possible coarsening of crystalline particles of steel thereby to improve the toughness. Where the quantity of N is greater than 0.02 wt. %, the above described effects will be saturated and, also, the machinability will be lowered.

Where S and Pb are optionally employed, the respective quantities of S and Pb employed in the practice of the method of the present invention must be not greater than 0.20 wt. % and not greater than 0.35 wt. %. Both of S and Pb are an element effective to improve the ability of the steel to be ground. Since the bainitic structure is somewhat hard to be ground, the presence of these elements in the steel member is effective to facilitate the steel member to be easily ground. In view of this, if the respective quantities of S and Pb are not greater than 0.20 wt. % and 0.35 wt. %, respective, the above described effect can be obtained without the physical properties of steel being impaired.

After the preparation of the starting material, that is, the steel material of the above described composition, the steel material is cut to any desired shape in readiness for a forging and is then hot-forged. Where the hot-forging is carried out at a temperature within the range of 850° to 950° C. of higher, the controlled cooling as will be described in detail later is effected to the hot-forged steel material when the latter attains a temperature within the range of 850° to 950° C. However, where the hot-forging is carried out at a temperature lower than 850° C., or where the steel material once hot-forged at the temperature within the range of 850° to 950° C. or higher, but subsequently cooled down to a temperature lower than 850° C., the steel material should be re-heated to the temperature within the range of 850° to 950° C. as a normalizing process to be taken subsequent to the hot-forging, followed the controlled cooling.

By the following reason, the steel material kept at a temperature within the range of 850° to 950° C. while representing an austenite structure is cooled in a controlled fashion.

When the temperature of the hot-forged steel material at which the controlled cooling is started is lower than 850° C., the allowing elements such as Mn, Cr and Mo will not become a solid solution sufficiently and, therefore, no sufficient heat treating characteristic can be obtained. On the other hand, when the temperature of the hot-forged steel material at which the controlled cooling is started is higher than 950° C., a portion of V carbonitride precipitated finely subsequent to the hot-forging will become a solid solution again and, therefore, no sufficient hardness can be obtained. Also, the coarsening of the grain size of the crystalline particles will occur accompanied by a lowering of the toughness.

The controlled cooling of the steel material referred to above is carried out continuously at a cooling speed of 0.4° to 4.0° C./sec down to room temperature when and after the steel material representing the austenitic structure has attained at the predetermined temperature within the range of 850° to 950° C., thereby providing the steel material with the bainite structure or the combined bainite and ferrite structure.

If the cooling speed is lower than 0.4° C., pearlite will precipitate in a major portion of the steel material, but if the cooling speed is higher than 4.0° C., martensite will precipitate in a major portion of the steel material. Therefore, the use of the cooling speed at a rate other than this range of cooling speed is undesirable in the practice of the method of the present invention.

After the controlled cooling of the steel material down to the room temperature, the steel material is machined to a desired shape thereby to provide an intended steel member which may be an automobile component part.

By the utilization of the continuous cooling or anisothermal cooling, not isothermal cooling, as hereinbefore described in accordance with the present invention, the matrix of the steel material can exhibit the bainite structure or the combined bainite and ferrite structure which is excellent in physical strength and toughness and the resultant steel material can have an increased toughness (increased impact strength) as compared with the ordinary non-tempered steel.

The steel member so manufactured according to the method of the present invention may be, for example, a connecting rod or crankshaft used in an automobile engine system or a gear member used in any machine. If desired, and/or depending on the application of the steel member, the steel member may then be subjected to any known nitriding process, including any known soft nitriding process, to improve a fatigue strength of the steel member. For example, the application of the nitriding process to the gear member is particularly recommended although not always limited thereto. The nitriding process which can be employed in practice of the method of the present invention may include, for example, an ion nitriding, a gas nitriding, a gasless nitriding, a liquid nitriding or any other known nitriding process.

As hereinbefore described, the continuous cooling or anisothermal cooling when carried out at the controlled cooling speed subject to the steel material of the specific composition makes the matrix of the steel material can exhibit the bainite structure or the combined bainite and ferrite structure. In addition, since the steel material contain the controlled quantities of Cr, V and Al which, when combined with N, produce a relatively hard nitride, the subsequent application of the nitriding process or soft nitriding process to the steel member can result in the formation of a hardened surface layer deep in a surface region of the steel member and, therefore, the fatigue strength of the steel member can be improved considerably.

Also, the steel member manufactured according to the present invention has a tough matrix exhibiting the bainite structure or the combined bainite and ferrite structure and, therefore, any possible propagation of cracking within the hardened surface layer can be advantageously suppressed. Yet, since V and Mo contained in the steel member serve as an element effective to increase a resistance to softening incident to tempering, the hardness of the matrix of the steel member will not be easily lowered during the nitriding.

Hereinafter, the present invention will be demonstrated by way of a series of experiments carried out to determine the amount of each of Mo, Mn and Cr to be employed, the controlled cooling speed and other conditions to be employed in the manufacture of the steel member according to the present invention.

Figure 2:
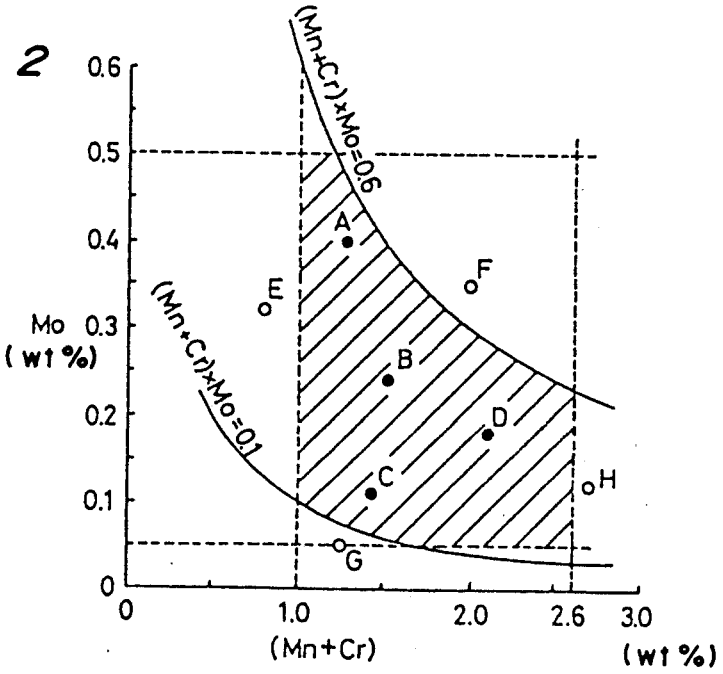
FIG. 2 is a graph showing the relationship between the controlled cooling speed and the product of the sum of the Mn content and the Cr content times the Mo content, illustrating a region in which the bainite or combined bainite and ferrite can be obtained as results of experiments set forth under Experiment I.

EXPERIMENT I (Table 1 and FIG. 2)

Using eight kinds of steel material of respective compositions shown in Table 1, round rods each 30 mm in diameter, identified by A to H, respectively, were manufactured by the use of a hot-forging. These round rods were subsequently heated (normalized) from normal temperatures to 900° C., followed by the controlled continuous cooling at a cooling speed of 1.0° C./sec. Thereafter, respective metallurgical structures of the round rods A to H were analyzed, results of which are tabulated in Table 1. It is to be noted that in Table 1, (B), (F), (P) and (M) represent bainite, ferrite, pearlite and martensite, respectively.

TABLE 1

| | Chemical Composition (wt %) | | | | | | | Cooling Speed | Matrix Structure |
|---|---|---|---|---|---|---|---|---|---|
| | C | Si | Mn | Cr | Mo | V | (Mn + Cr) × × Mo | | |
| A: | 0.26 | 0.29 | 0.60 | 0.68 | 0.40 | 0.12 | 0.51 | 1.0 | (B) + (F) |
| B: | 0.27 | 0.27 | 0.75 | 0.77 | 0.24 | 0.10 | 0.36 | 1.0 | (B) + (F) |
| C: | 0.25 | 0.26 | 0.63 | 0.80 | 0.11 | 0.09 | 0.16 | 1.0 | (B) + (F) |
| D: | 0.24 | 0.30 | 1.02 | 1.09 | 0.18 | 0.11 | 0.38 | 1.0 | (B) + (F) |
| E: | 0.28 | 0.31 | 0.48 | 0.33 | 0.32 | 0.08 | 0.26 | 1.0 | (B) + (F) + (P) |
| F: | 0.27 | 0.24 | 0.87 | 1.13 | 0.35 | 0.11 | 0.70 | 1.0 | (M) + (B) |
| G: | 0.25 | 0.28 | 0.62 | 0.63 | 0.05 | 0.10 | 0.06 | 1.0 | (B) + (F) + (P) |
| H: | 0.23 | 0.25 | 1.46 | 1.25 | 0.12 | 0.13 | 0.33 | 1.0 | (M) + (B) |

In Table 1 above, the round rods identified by A to D, respectively, are the products manufactured according to the method of the present invention, whereas the round rods identified by E to H are the products presented for the purpose of comparison.

When the results of experiments are plotted in a graph, wherein the axis of abscissas represents the sum of the respective contents of Mn and Cr used and the axis of ordinates represents the content of Mo used as shown in FIG. 2, and when in such graph the range of amount of Mo and the range of (Mn+Cr)×Mo value both applicable to the method of the present invention are examined, a hatched area in the graph of FIG. 2 can be obtained. In other words, when the quantity of Mo is chosen within the range of 0.05 to 0.50 wt %, the sum of the respective quantities of Mn and Cr is chosen within the range of 1.0 to 2.6 wt % and the (Mn+Cr)×Mo value is chosen within the range of 0.1 to 0.6 as encompassed within the hatched area in the graph of FIG. 2, the combined bainite and ferrite structure could be obtained in the steel material manufactured according to the present invention.

If the (Mn+Cr)×Mo value is smaller than 0.1, the matrix tends to contain pearlite in addition to bainite and ferrite as represented by the round rod G, whereas if the (Mn+Cr)×Mo value is greater than 0.6, the matrix tends to contain martensite in combination with bainite as represented by the round rod F. The presence of pearlite or martensite such as in the round G or F is not desirable for the purpose of the present invention.

Figure 3:
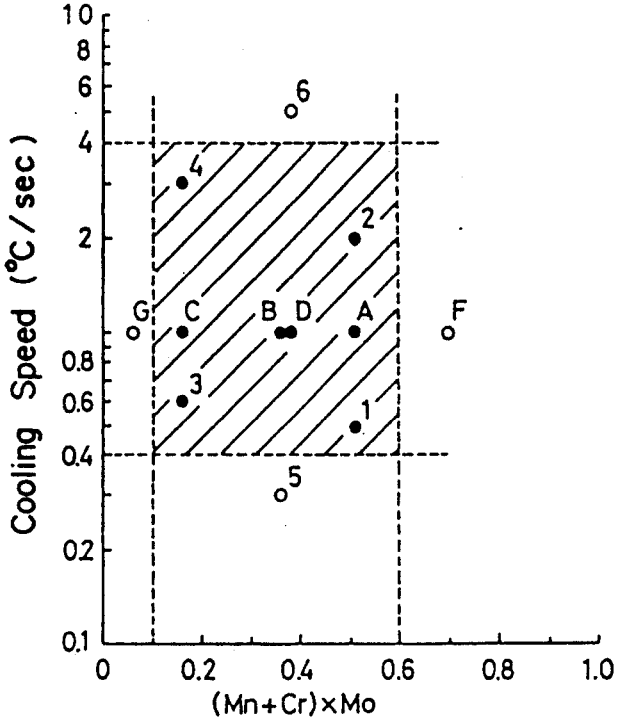
FIG. 3 is a graph showing the relationship between the Mo content and the sum of the Mn content and the Cr content, illustrating a region in which bainite or combined bainite and ferrite can be obtained as results of experiments set forth under Experiments I and II.

EXPERIMENT II (Table 2 and FIG. 3)

Using the same steel materials as those for the round rods A to D in Experiment I, round rods identified respectively by Nos. 1 to 6, each 30 mm in diameter, were manufactured by the use of a hot-forging technique. These round rods Nos. 1 to 6 were subsequently heated from normal temperatures to 900° C. and were continuously cooled at respective cooling speeds, as shown in Table 2. Thereafter, respective metallurgical structures of the round rods Nos. 1 to 6 were analyzed, results of which are tabulated in Table 2 and FIG. 3. It is to be noted that in FIG. 3 the result of Experiment I is also shown.

TABLE 2

| Nos. | Chemical Composition | (Mn + Cr) × Mo | Cooling Speed | Matrix Structure | Charpy Impact Strength (kgf · m/cm$^2$) |
|---|---|---|---|---|---|
| 1 | Same as A | 0.51 | 0.5 | (B) + (F) | 11.7 |
| 2 | Same as A | 0.51 | 2.0 | (B) | 10.5 |
| 3 | Same as C | 0.16 | 0.6 | (B) + (F) | 12.2 |
| 4 | Same as C | 0.16 | 3.0 | (B) | 10.8 |
| 5 | Same as B | 0.36 | 0.3 | (B) + (F) + (P) | 6.3 |
| 6 | Same as D | 0.38 | 5.0 | (M) + (B) | 5.5 |

In Table 2 above, the round rods identified by Nos. 1 to 4, respectively, are the products manufactured according to the method of the present invention, whereas the round rods identified by Nos. 5 and 6 are the products presented for the purpose of comparison.

The round rods Nos. 1 to 6 were, after having been machined to provide respective No. 3 Charpy testpieces as defined in JIS (Japanese Industrial Standards) Z2202, were tested as to Charpy impact strength, respective results of which are shown in Table 2 above. Table 2 indicates that the steel member having the bainite structure or the combined bainite and ferrite structure can exhibit both a high impact strength and a high toughness.

As can be understood from the experimental results under Experiment II above, the employment of the (Mn+Cr)×Mo within the range of 0.1 to 0.6 and, at the same time, the controlled continuous cooling speed within the range of 0.4° to 4.0° C./sec is effective to provide the steel member with the bainite structure or the combined bainite and ferrite structure. If the controlled continuous cooling speed is lower than 0.4° C./sec, pearlite tends to precipitate in addition to a combination of bainite and ferrite as shown by the round rod No. 5, with both of the physical strength and the toughness lowered consequently. On the other hand, if the controlled continuous cooling speed is higher than 4.0° C./sec. martensite tends to precipitate in addition to bainite as represented by the round rod No. 6, with the toughness lowered consequently. Accordingly, in the practice of the method of the present invention, the controlled continuous cooling speed is preferred to be within the range of 0.4° to 4.0° C./sec.

EXPERIMENT III

(FIG. 4)

Figure 4:
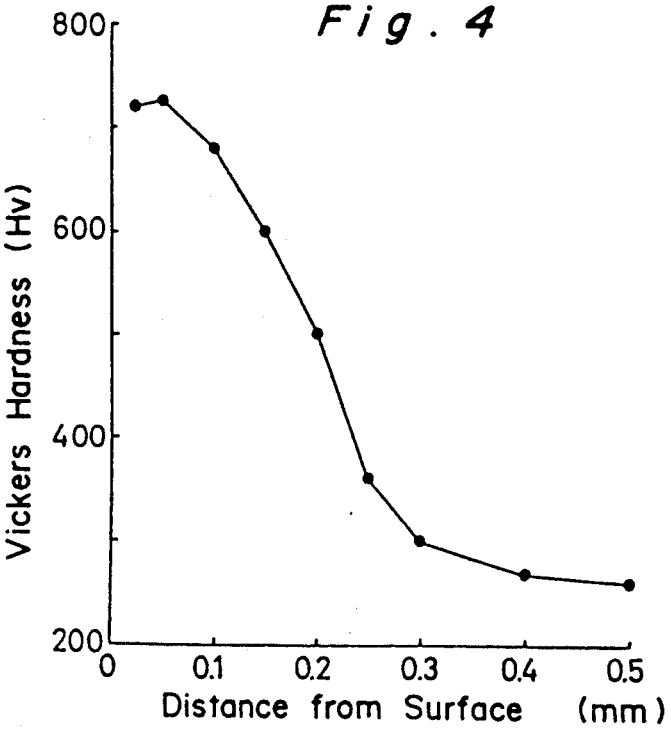
FIG. 4 is a graph showing a change in Vickers hardness obtained in Experiment III.

A gas nitriding process was applied to the round rod D, manufactured as in Experiment I, at 570° C. for three hours under a condition of $NH^3/RX=50/50$ (wherein RX represents a modified exothermic gas), followed by a Vickers hardness measurement to determine how the hardness varies from a surface region to an internal region. A result of the measurement is shown in the graph of FIG. 4 which illustrates that the round rod D has an acceptable hardness from the surface region to the internal region. In particular, the surface region of 0.2 mm in depth exhibits the Vickers hardness Hv higher than 500 and this is illustrative of the fact that the round rod D has an increased resistance to pitting.

OTHER EMBODIMENTS

As hereinbefore described, when the steel having the bainite structure is nitrided, the steel member excellent in physical strength can be manufactured. However, in the case of a gear member of a type that requires a relatively complicated and delicate grinding work, there may arise a problem in that the dimensions thereof may change when and after it has been nitrided. In other words, since the bainitic structure is difficult to grind and, therefore, tends to exhibit a relatively high resistance to grinding during the gear grinding work accompanied by a build-up of internal stresses in the gear member during the grinding. The internal stresses built in the gear member tends to constitute a cause of thermal deformation of the gear member when the latter is nitrided.

According to an alternative embodiment of the present invention, as steel material for the gear member substantially free from the above discussed problem, the following composition shown in Table 3 is employed, the present by weight being based on the total weight of the steel material.

TABLE 8

| C | Si | Mn | P | S | Cr | Mo | V | Pb |
|---|---|---|---|---|---|---|---|---|
| 0.25 | 0.28 | 0.95 | 0.012 | 0.023 | 1.07 | 0.18 | 0.11 | 0.10 |

Figure 5:
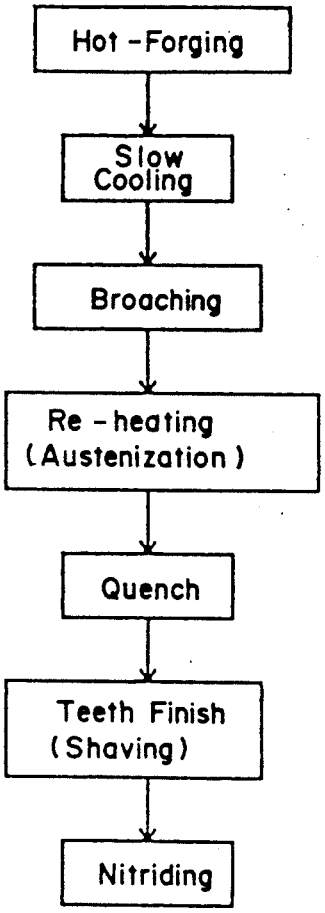
FIG. 5 is a chart showing the sequence of manufacture of a gear member according to another preferred embodiment of the present invention.
Figure 6:
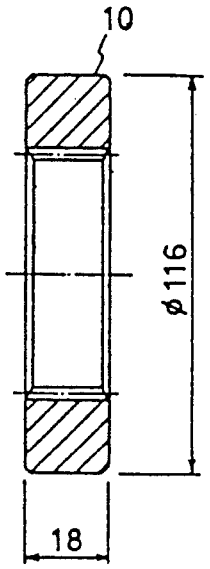
FIG. 6 is a sectional view of an internal gear prepared from the gear member manufactured according to the method shown in FIG. 5.

The gear member using the steel material of the composition shown in Table 3 is manufactured according to a method shown in FIG. 5. Referring to FIG. 5, after the hot-forging, the steel material is slowly cooled to normal temperatures to render it to have a combined ferrite and pearlite structure and a predetermined machining is carried on the cooled steel material. With the use of a broaching machine, the steel material is subsequently broached to provide such an internal gear member 10 as shown in FIG. 6. This gear member 10 is then heated in a non-oxidizing atmosphere to a temperature higher than the austenitizing temperature, that is, to a temperature within the range of 850° to 950° C., followed by the continuous cooling at the controlled cooling speed of 0.4° to 4.0° C./sec to provide the bainite structure or the combined bainite and ferrite structure. Thereafter, the gear member 10 has its gear teeth finished by the use of a shaving machine, followed by nitriding.

To demonstrate the effectiveness of the alternative method of the present invention described with reference to FIGS. 5 and 6, two gear members identified respectively by AA and BB were manufactured with the use of the steel material of the composition shown in Table 3.

The gear members AA and BB were, during the manufacture thereof, continuously cooled at different cooling speeds, as shown in Table 4 below, to cause the gear member AA to have a combined ferrite and pearlite structure and to cause the gear member BB to have a combined ferrite and bainite structure.

TABLE 4

| Members | Cooling Speed | Matrix Structure | Remarks |
|---|---|---|---|
| AA | 0.2° C./sec | (F) + (P) | Invention |
| BB | 1.0° C./sec | (F) + (B) | Comparison |

Each of these gear member AA and BB were subsequently broached to provide such a respective internal gear member as shown in FIG. 6. During the formation of the gear teeth in each of the gear members AA and BB, a cutter made of SKH9 was employed and the broaching operation was carried out at a grinding speed of 4.5 m/min, the particulars of each resultant gear member being shown in Table 5 below.

TABLE 5

| Module | Number of Teeth | Pressure Angle | Over-pin Diameter* |
|---|---|---|---|
| 1.75 | 51 | 20° C. | ϕ 86 (Pin: 3 mmϕ) |

[Over-pin Diameter: Minimum distance between pins of 3 mm in diameter which are inserted in respective tooth grooves in an internal gear member which are spaced 180° circumferentially from each other.]

The gear member AA was thereafter heated to 910° C. and was subsequently cooled continuously at a cooling speed of 1.0° C./sec to form the combined ferrite and bainite structure, followed by shaving to complete the internal gear member. On the other hand, the gear member BB was subjected to the shaving process following the broaching process. Both of the gear members AA and BB were finally surface-hardened by the use of a soft nitriding process carried at 570° C. for 3.5 hours under a condition of $NH^3/RX=50/50$ (wherein RX represents a modified exothermic gas).

After the completion of manufacture of the gear members AA and BB, a measurement is carried out to determine the over-pin diameter in each gear member with respect to each of X and Y directions perpendicular to each other, results of the measurement being tabulated in Table 6 below. It is to be noted that in determination of the over-pin diameter the two pins of 3 mm in diameter were employed.

TABLE 6

| Gear Member | Amount of Change in Over-pin Diameter X Direction | Y Direction | Remarks |
|---|---|---|---|
| AA | +14 μm | +16 μm | Invention |
| BB | +7 μm | +25 μm | Comparison |

As shown in Table 6 above, the amount of change in over-pin diameter in the gear member BB in each of the X and Y directions is greater than that in the gear member AA, signifying a reduction in dimensional precision, that is, a greater deviation from circularity, as compared with that in the gear member AA.

In view of the foregoing, the gear member excellent in circularity and having an increased physical strength, an increased hardness, an increased fatigue strength and an increased toughness can be manufactured by carrying out the broaching process while the case represents the combined ferrite and pearlite structure which is relatively low in hardness and excellent in grindability, for minimizing the internal stresses which would be built up during the broaching, and by providing the case with the combined ferrite and bainite structure subsequent to the broaching by re-heating and cooling it, followed by the nitriding or soft nitriding subjected to the case. It is pointed out that, although in the foregoing description reference has been made to the manufacture of the gear members, the method described above can be equally applicable to the manufacture of any other machine component parts which tend to exhibit a relatively high resistance to grinding and which requires a relatively large amount of material to be ground.

Although the present invention has been fully described in connection with the preferred embodiments thereof with reference to the accompanying drawings, it is to be noted that various changes and modifications are apparent to those skilled in the art. Such changes and modificiations are to be understood as included within the scope of the present invention as defined by the appended claims unless they depart therefrom.

What is claimed is:

1. A method for manufacturing a steel member which comprises the steps of:

preparing a steel material of a composition containing C (carbon) in a quantity of 0.15 to 0.35 wt %, Si (silicon) in a quantity of not greater than 0.50 wt %, Mo (molybdenum) in a quantity of 0.05 to 0.50 wt %, Mn (manganese) in a quantity of 0.50 to 1.30 wt %, Cr (chromium) in a quantity of 0.50 to 1.30 wt %, V (vanadium) in a quantity of 0.05 to 0.20 wt %, N (nitrogen) in a quantity not greater than 0.02 wt %, Al (aluminum) in a quantity of not greater than 0.10 wt % and Fe (iron) being the balance relative to the total weight of the steel material, wherein the product of the sum of the Mn content and the Cr content times the Mo content is chosen to be within the range of 0.1 to 0.6;

hot-forging the steel material at a predetermined heating temperature to provide the steel member; and continuously cooling the steel member at a predetermined cooling speed of 0.4° to 4.0° C./sec to impart a substantially bainite structure or a combined bainite and ferrite structure to the steel member.

2. The method as claimed in claim 1, wherein said predetermined heating temperature is within the range of 850° to 950° C. and wherein said continuous cooling step is carried out when the steel member is at a temperature within the range of 850° to 950° C.

3. The method as claimed in claim 1, further comprising a step of heating the steel member to a temperature within the range of 850° to 950° C., said heating step being carried out subsequent to the hot-forging step, and wherein said continuous cooling step is carried out when the steel member is at a temperature within the range of 850° to 950° C.

4. The method as claimed in claim 1, further comprising a step of nitriding the steel member which is carried out subsequent to the continuous cooling step.

5. A method for manufacturing a steel member which comprises the steps of:

preparing a steel material of a composition containing C (carbon) in a quantity of 0.15 to 0.35 wt %, Si (silicon) in a quantity of not greater than 0.50 wt %, Mo (molybdenum) in a quantity of 0.05 to 0.50 wt %, Mn (manganese) in a quantity of 0.50 to 1.30 wt %, Cr (chromium) in quantity of 0.50 to 1.30 wt %, V (vanadium) in a quantity of 0.05 to 0.20 wt %, N (nitrogen) in a quantity not greater than 0.20 wt %, Al (aluminum) in a quantity of not greater than 0.10 wt % and Fe (iron) being the balance relative to the total weight of the steel material, wherein the product of the sum of the Mn content and the Cr content times the Mo content is chosen to be within the range of 0.1 to 0.6;

hot-forging the steel material at a predetermined heating temperature to provide the steel member;

cooling the hot-forged steel member;

re-heating the steel member to a temperature within the range of 850° to 950° C.; and continuously cooling the steel member at a predetermined cooling speed of 0.4° to 4.0° C./sec from the temperature of 850° to 950° C. to impart a substantially bainite structure or a combined bainite and ferrite structure to the steel member.

6. The method as claimed in claim 5, wherein said predetermined heating temperature is within the range of 850° to 950° C.

7. The method as claimed in claim 5, further comprising a step of nitriding the steel member which is carried out subsequent to the continuous cooling step.

8. The method as claimed in claim 5, wherein said cooling step is carried out slowly, and further comprising a step of machining the steel member subsequent to the slow cooling step and prior to the re-heating step and a step of shaping the steel member to provide a shaped steel member subsequent to the continuous cooling.

9. The method as claimed in claim 8, further comprising a step of nitriding the shaped steel member.

10. The method according to claim 1 wherein Cr is present at 0.68 to 0.80 wt %.

11. The method according to claim 5 wherein Cr is present at 0.68 to 0.80 wt %.

12. The method according to claim 1 wherein C is 0.26 wt %, Si is 0.29 wt %, Mn is 0.60 wt %, Cr is 0.68 wt %, Mo is 0.40 wt %, V is 0.12 wt % and $(Mn+Cr)\times Mo$ is 0.51.

13. The method according to claim 5 wherein C is 0.26 wt %, Si is 0.29 wt %, Mn is 0.60 wt %, Cr is 0.68 wt %, Mo is 0.40 wt %, V is 0.12 wt % and $(Mn+Cr)\times Mo$ is 0.51.

14. The method according to claim 1 wherein C is 0.25 wt %, Si is 0.26 wt %, Mn is 0.63 wt %, Cr is 0.80 wt %, Mo is 0.11 wt %, V is 0.09 wt % and $(Mn+Cr)\times Mo$ is 0.16.

15. The method according to claim 5 wherein C is 0.25 wt %, Si is 0.26 wt %, Mn is 0.63 wt %, Cr is 0.80 wt %, Mo is 0.11 wt %, V is 0.09 wt % and $(Mn+Cr)\times Mo$ is 0.16.

* * * * *